US008991060B2

(12) United States Patent
Safar

(10) Patent No.: US 8,991,060 B2
(45) Date of Patent: Mar. 31, 2015

(54) FINGERTIP SHAVING DEVICE

(71) Applicant: Samir Hanna Safar, San Diego, CA (US)

(72) Inventor: Samir Hanna Safar, San Diego, CA (US)

(73) Assignee: Samir Hanna Safar, San Diego, CA (US)

( * ) Notice: Subject to any disclaimer, the term of this patent is extended or adjusted under 35 U.S.C. 154(b) by 221 days.

(21) Appl. No.: 13/723,060

(22) Filed: Dec. 20, 2012

(65) Prior Publication Data

US 2014/0173905 A1 Jun. 26, 2014

(51) Int. Cl.
*B26B 21/52* (2006.01)

(52) U.S. Cl.
CPC ..... *B26B 21/527* (2013.01)
USPC ..... 30/298; 30/50; 30/526; 30/347

(58) Field of Classification Search
CPC .... B26B 21/52; B26B 21/522; B26B 21/527; B26B 21/56; B26B 21/4043; B26B 21/4068
USPC ..... 30/34.1, 34.05, 43.4–43.6, 29.5, 30/526–537, 298, 232, 240, 198; 407/7, 407/29.11; 451/524, 525
See application file for complete search history.

(56) References Cited

U.S. PATENT DOCUMENTS

| | | | | | |
|---|---|---|---|---|---|
| 3,314,146 | A * | 4/1967 | Cooksey | 30/43.6 |
| 4,107,840 | A * | 8/1978 | Kupperman et al. | 30/172 |
| 5,357,680 | A | 10/1994 | Monistere | |
| D386,819 | S | 11/1997 | Doyle | |
| 5,802,720 | A * | 9/1998 | Pribe | 30/32 |
| D410,112 | S * | 5/1999 | Doyle | D28/46 |
| 6,018,877 | A | 2/2000 | Greene | |
| 6,029,356 | A | 2/2000 | Sprinkle | |
| D426,918 | S * | 6/2000 | Greene | D28/48 |
| D431,095 | S * | 9/2000 | Hyman | D28/45 |
| 6,505,403 | B1 | 1/2003 | Andrews | |
| 6,550,148 | B2 | 4/2003 | Cecil | |
| 7,007,393 | B2 * | 3/2006 | Guimont | 30/346.57 |
| 7,475,481 | B1 * | 1/2009 | Napoli | 30/43.4 |
| 2010/0037414 | A1 * | 2/2010 | Dimos | 15/245.1 |
| 2011/0113631 | A1 | 5/2011 | Zdunek | |

FOREIGN PATENT DOCUMENTS

| | | |
|---|---|---|
| CN | 101758507 | 6/2010 |
| GB | 2465422 | 5/2010 |
| JP | 6154436 | 6/1994 |
| JP | 2002018160 | 1/2002 |
| JP | 2009039186 | 2/2009 |
| WO | WO/2012/107713 | 8/2012 |

* cited by examiner

*Primary Examiner* — Ned Landrum
*Assistant Examiner* — Evan MacFarlane

(57) ABSTRACT

A fingertip mountable shaving device is provided by a flexible and breathable substrate layer including a first shaving surface, and a second adhesive surface opposite to the first shaving surface. The first shaving surface includes a plurality of rubber strips along the vertical peripheral edge and a plurality of blade assemblies affixed at predetermined locations. The blade assemblies of include a vertical stack of a plurality of rotary blades of different diameters alternately interspaced by spacers and having a hemi-spherical protective cap with a vertical stem, on the top. The second adhesive surface is coated with an adhesive suitable for temporarily mounting the device on a fingertip and is covered with a releasably connected protective peel off layer. The device can safely and closely shave hair from the face and other difficult to reach body surfaces, such as within the ear or nostrils.

16 Claims, 4 Drawing Sheets

FINGERTIP SHAVING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The present invention relates to a hair shaving device, more specifically to a fingertip mountable and manually operated shaving device. The invention aims to provide a flexible and disposable hair shaving device, suitable for single use that allows safe and close shaving particularly from difficult to access body parts by relying on the sense of feel rather than visibility of the surface to be shaved.

2. Background Art

Different finger mountable shaving devices used to shave hair from difficult to access body parts such as nostrils or ears are known in prior art. These devices range from manually operated to battery powered devices and may or may not be disposable. Many of these devices are bulky and are not easy to carry or use inside the nose, ears or on wrinkled skin surface.

Several such shaving devices included in the prior art are known to the inventor, but they distinctly differ from the present invention described in this patent application. The present invention offers a solution the above mentioned problems associated with prior art.

Below are given some prior art references. U.S. Pat. No. 6,550,148, issued on Apr. 22, 2003, titled, "SHAVING METHOD AND APPARATUS", describes a shaving device wherein the razor is placed between the user's fingers and held by the combined grip. This device is not suitable for shaving intricate body surfaces such as those inside the nose or ears.

U.S. Pat. No. 6,029,356, issued on Feb. 29, 2000, titled, "FINGER PAD SENSOR RAZOR", discloses a razor mounted on full or partial rings which slide all the way over the fingers to their proximal ends to be used as sensory feedback means of hair stubble condition. This device too is not suitable for shaving intricate body surfaces such as those inside the nose or ears.

U.S. Pat. No. 6,018,877, issued on Feb. 1, 2000, titled, "VERSATILE FINGER RETAINED RAZOR", provides a finger engaged razor that is configured for selectively shaving the head or face. This device is also unsuitable for shaving intricate body surfaces such as those inside the nose or ears.

U.S. Pat. No. 6,505,403, issued on Jan. 14, 2003, titled, "HAIR SHAVING DEVICE WITH U-SHAPED RAZOR BLADE STRIP", provides a manually manipulatable non electric hair trimming device, which is neither flexible nor disposable.

US Patent Application No. 20110113631, published on May 19, 2011, titled, "APPARATUS AND METHOD OF HOLDING RAZORS", provides a razor holder for use with a plurality of razor elements and includes a hand wearable article configured to fit over a hand of a user. This shaving device is also not suitable for shaving intricate body surfaces such as those inside the nose or ears.

U.S. Pat. No. 5,357,680, issued on Oct. 25, 1994, titled, "FINGER RAZOR", provides a finger razor that completely fits snugly onto the middle or index finger. This is a rigid device that is unsuitable for shaving intricate body surfaces such as those inside the nose or ears.

PCT Patent Application No. WO/2012/107713, published on Aug. 16, 2012, titled, "A RAZOR", provides a razor which is placed on at least one finger of the user's hand and has at least one blade. This device also involves use of a rigid surface that is unsuitable for shaving intricate body surfaces such as those inside the nose or ears.

UK Patent No. GB2465422, issued on May 26, 2010, titled, "FINGER-MOUNTED DISPOSABLE SHAVING RAZOR", provides a razor mounted on a band to be placed on a finger. This device also involves use of a rigid surface that is unsuitable for shaving intricate body surfaces such as those inside the nose or ears.

Chinese Patent Application No. CN 101758507, published on Jun. 30, 2010, titled, "FINGER-HELD DOUBLE-SIDED RAZOR", relates to a finger-held double-sided razor, which is again a rigid device unsuitable for shaving intricate body surfaces such as those inside the nose or ears.

Chinese Patent Application No. CN 202180480, published on Apr. 4, 2012, titled, "RAZOR", relates to a finger worn razor, which is again a rigid device unsuitable for shaving intricate body surfaces such as those inside the nose or ears.

Japanese Patent Application No. JP 2009039186, published on Feb. 26, 2009, titled, "DOUBLE-EDGED FINGER RAZOR WITH BAND", describes a double-edged finger razor which is again a rigid device unsuitable for shaving intricate body surfaces such as those inside the nose or ears.

Japanese Patent Application No. JP 2002018160, published on Jan. 22, 2002, titled, "FINGER INSERTION TYPE SAFETY RAZOR", provides a razor edge holding part that can be worn over a finger. However this is a rigid device unsuitable for shaving intricate body surfaces such as those inside the nose or ears.

Japanese Patent No. 6154436, issued on Jun. 3, 1994, titled, "HAND/FINGER TOUCHING TYPE SAFETY RAZOR", provides hand/finger touching type safety razor that can be worn on a single or multiple fingers. However this is also a rigid device unsuitable for shaving intricate body surfaces such as those inside the nose or ears.

U.S. Design Pat. No. D410,112, issued on May 18, 1999, titled, "FINGER-MOUNTED RAZOR", provides an ornamental design for a finger-mounted razor which is unsuitable for shaving intricate body surfaces such as those inside the nose or ears.

U.S. Design Pat. No. D386,819, issued on Nov. 25, 1997, titled, "FLEXIBLE FINGER-MOUNTED RAZOR", provides an ornamental design for a finger-mounted razor which is unsuitable for shaving intricate body surfaces such as those inside the nose or ears.

None of the previously described prior art references provide a shaving device that is capable of being mounted on a fingertip and is flexible, disposable, small, light in weight, easy to operate, non-electric, facilitates shaving by feel, and also provides a safe and close saving finish while accessing intricate body parts. The present invention satisfies the present and other needs.

BRIEF SUMMARY OF THE INVENTION

The present invention provides for a non-electric, disposable and flexible fingertip mountable shaving device that offers a safe and close shaving finish. A shaving device in accordance with the present invention is characterized by a flexible and breathable substrate layer comprising of (i) a first shaving surface having a plurality of blade assemblies, and (ii) a second adhesive surface configured for temporarily adhering to the human skin, wherein said first surface is opposite to said second surface across a transversal axis of said substrate layer.

The first shaving surface includes a plurality of rubber strips running along the vertical peripheral edge and the plurality of blade assemblies affixed at predetermined locations on the flexible and breathable substrate layer. A member of said blade assemblies comprises of a vertical stack of a plurality of rotary blades of different diameters alternately interspaced by a plurality of spacers and having a hemi-spherical protective cap with a vertical stem, on the top.

The second adhesive surface is coated with an adhesive suitable for application on the human skin and is covered with a releasably connected protective peel off layer.

The second adhesive surface is used for temporarily affixing the shaving device on the finger tip and the first shaving surface is used to shave hair from the face and other difficult to reach body surfaces, such as within the ear or nostrils.

The primary object of the present invention is to provide a shaving device that can safely and closely shave areas that are difficult to see and access such as, within the ear, nostrils, back of the neck.

Another object of the present invention is to provide a shaving device that facilitates shaving by feel and does not require a visual aid such as a minor while shaving.

A further object of the present invention is to provide a shaving device that is flexible and easily conforms to the contours of the skin surface to be shaved as well as the fingertip.

A still further object of the present invention is to provide a shaving device that is small in size, light in weight, easy to carry and comfortable to use.

Yet another object of the present invention is to provide a shaving device that is disposable and suitable for single use.

Yet further object of the present invention is to provide a shaving device that is not powered by any electrical source and can be conveniently operated manually.

Yet another object of the present invention is to provide a shaving device that allows shaving in multiple directions.

Still another object of the present invention is to provide a shaving device that is self adhesive in nature and does not require additional effort on part of the user to specifically hold in place by the user.

These and other objects of the present invention are further elaborated in the detailed description of the invention. These objects should be construed to be merely illustrative of some of the more prominent features and applications of the invention and not as to limit the scope of the invention. Applying or modifying the disclosed invention in a different manner can attain many other beneficial results or modifying the invention as will be described. Accordingly, referring to the following drawings may have a complete understanding of the invention. Description of the preferred embodiment is as follows.

BRIEF DESCRIPTION OF THE SEVERAL VIEWS OF THE DRAWINGS

For a better understanding of the present invention and its various embodiments, reference is made to the following detailed description to be read in conjunction with the accompanying drawings, wherein.

Figure 1A:
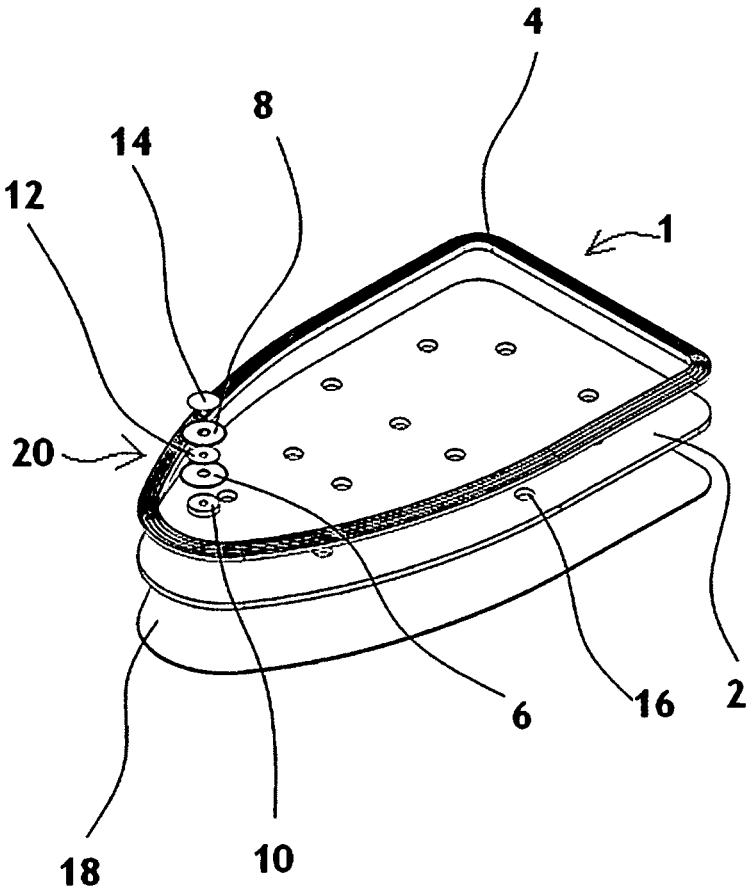
FIG. 1A shows a perspective view of the shaving device when viewed with the first shaving surface on top.

It should be understood that drawings are for the purpose of illustrating the concepts of the invention and are not to scale.

LIST OF REFERENCE NUMBERING

1 labels a shaving device
2 labels a first shaving surface
4 labels a rubber strip member
6 labels a first rotary blade
8 labels a second rotary blade
10 labels a bottom spacer
12 labels a middle spacer
14 labels a hemispherical protective cap with a vertical stem
16 labels a breathable opening
18 labels a second adhesive surface
20 labels a blade assembly
22 labels a protective peel off layer

DETAILED DESCRIPTION OF THE INVENTION

The present invention is now described with reference to the drawings.

Figure 1B:
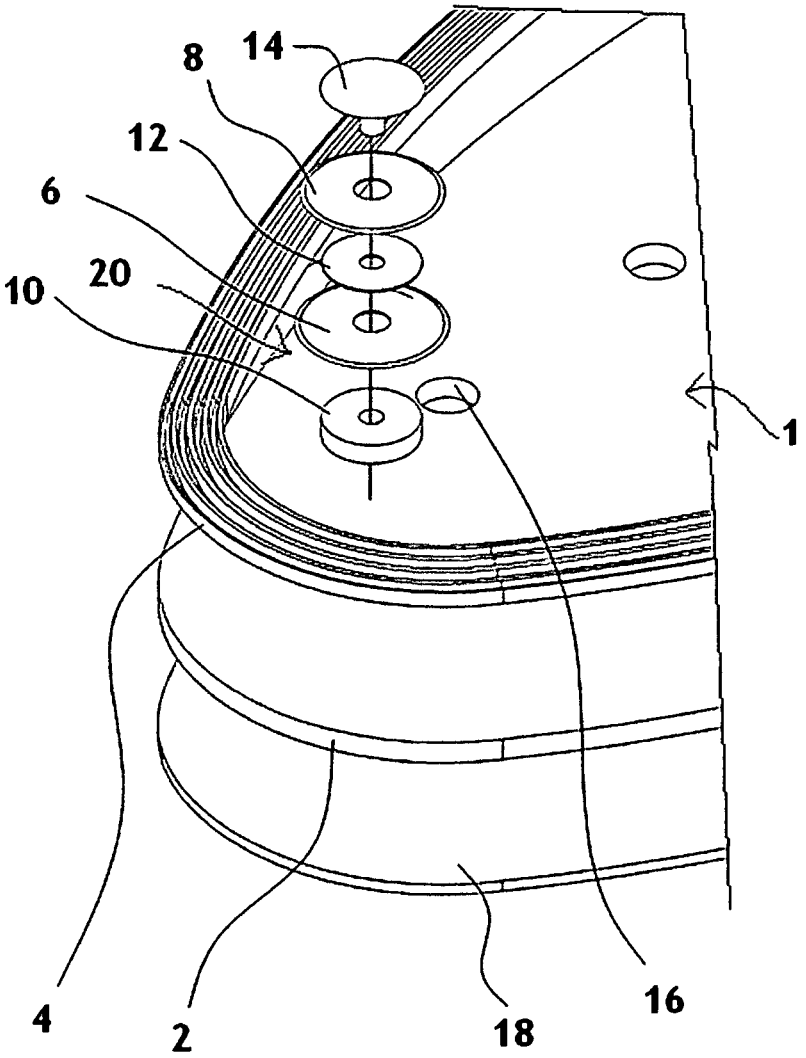
FIG. 1B shows a partial and enlarged perspective view of shaving device with an exploded view of the components of a blade assembly, when viewed with the first shaving surface on top.

Referring to FIGS. 1A and 1B, there is shown a perspective view of the shaving device 1 characterized by a flexible and breathable substrate layer. The shaving device 1 includes a first shaving surface 2 and a second adhesive surface 18 provided on the opposite side to said first shaving surface 2 across a transversal axis.

A plurality of breathable openings are provided on the flexible substrate layer to make it breathable and are thus present in a coinciding manner at predetermined locations on first shaving surface 2 and second adhesive surface 18. 16 denotes a breathable opening. A plurality of rubber strip members are provided continuously along the vertical peripheral edge of said first shaving surface 2 for making the hair stand up for smoother cut and for preventing any direct cut to the skin by rotary blades 6 and 8, subsequently described. 4 denotes a member of plurality of rubber strips. At predetermined locations on said first shaving surface 2, a plurality of blade assemblies are provided, wherein 20 denotes a member of plurality of said blade assemblies. In FIGS. 1A and 1B, 20 has been depicted with an exploded view of the components for illustrative purpose. A member of plurality of blade assemblies 20 includes a plurality of rotary blades, 6 and 8; a plurality of spacers 10 and 12, alternately disposed between said rotary blades 6 and 8 and a hemispherical protective cap with a stem 14. Said rotary blades 6 and 8, and said spacers 10 and 12 possess a central opening and are vertically stacked on each other alternately. The hemispherical protective cap with a vertical stem 14 is positioned as the topmost component of 20 with the stem section extending through the central openings of said rotary blades 6 and 8 and said spacers 10 and 12. The rotary blades 6 and 8 facilitate shaving in any direction. The spacers 10 and 12 aid the rotary blades 6 and 8 to achieve the desired shaving finish. The hemispherical protective cap 14 prevents accidental cuts on the skin and facilitates smooth gliding on the skin surface. In an embodiment of the invention, the order of vertical stacking in a member of plurality of blade assemblies is as follows starting from the bottom and moving upwards: Bottom spacer 10, first rotary blade 6, middle spacer 12, second rotary blade 8, hemispherical protective cap with a vertical stem 14. Members of plurality of blade assemblies may be affixed to first shaving surface 2 by using an adhesive or bonding method.

The number of pairs of rotary blades and spacers in a member of the plurality of blade assemblies may be two or more. In an embodiment of the invention, the number of pairs of rotary blades and spacers in a member of the plurality of blade assemblies is one.

The rotary blades 6 and 8 are preferably made of stainless steel. The spacers 10 and 12 and the hemispherical protective cap with a vertical stem 14 are preferably constructed out of a plastic material.

Figure 2:
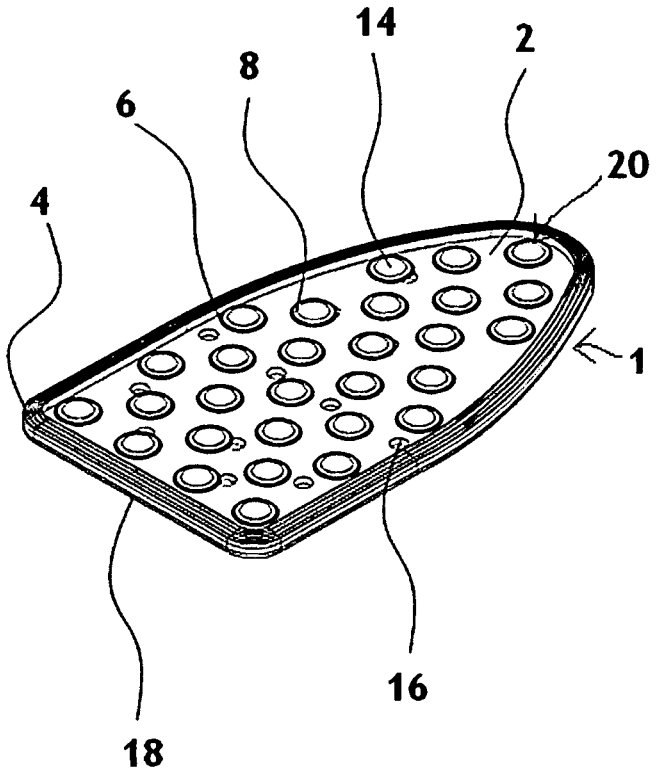
FIG. 2 shows another perspective view of the shaving device with the components of a blade assembly in assembled form, when viewed with the first shaving surface on top.

Referring to FIG. 2, a plurality of the assembled blade assemblies affixed on to first shaving surface 2 is displayed.

Figure 3:
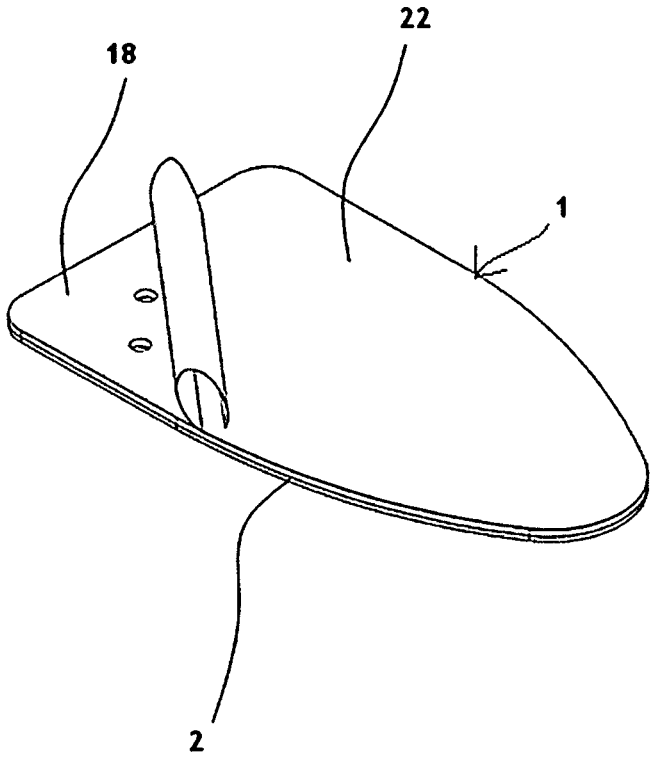
FIG. 3 displays a perspective view of the shaving device when viewed with the second adhesive surface on top.

Referring to FIG. 3, the shaving device 1 is displayed with the second adhesive surface 18 provided on the upward side and the first shaving surface 2 on the downward side. The second adhesive surface 18 is coated with an adhesive suitable for application on the human skin and includes a releasably connected protective peel off layer 22. The protective peel off layer 22 is attached to the second adhesive surface 18 using any suitable adhesive or bonding method.

The protective peel off layer 22 may be connected to the second adhesive surface 18 either completely, substantially or partly.

Figure 4:
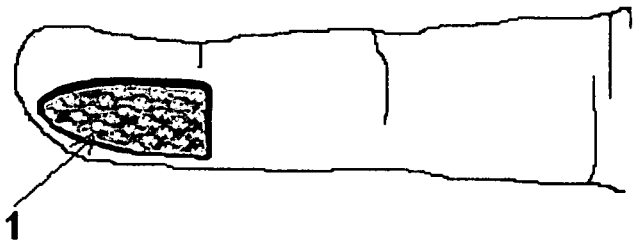
FIG. 4 illustrates the shaving device mounted on the user's fingertip

Referring to FIG. 4, the shaving device 1 is displayed after being mounted on a finger tip, wherein it remains adhered to the skin and does not fall off.

In a preferred embodiment of the invention, the diameter of rotary blades 6 and 8 and spacers 10 and 12 is in the range of 1 mm to 2 mm.

In a preferred embodiment of the invention, the flexible, waterproof and breathable substrate layer of the shaving device 1 is made of a material such as latex based, non-latex based, natural or synthetic fibres.

Equivalent commercially available forms of such substrate layer include products such as BAND-AID® (Johnson & Johnson), ELASTOPLAST@ (Beiersdorf AG).

In a preferred embodiment of the invention, the shaving device comprises of two pairs of rotary blades and spacers.

In a preferred embodiment of the invention, the shape of blades is circular.

In an embodiment of the invention, the adhesive coating on the second adhesive surface 18 may be a substance such as a hypoallergenic pressure sensitive adhesive suitable for application on human skin as acrylic or silicone based adhesive material thereby providing the additional benefit of "stay in place" functionality.

In a preferred embodiment of the invention, the shape of the shaving device 1 is designed in a shape similar to the finger tip of an adult human being.

In an embodiment of the present invention, the hemispherical protective cap 14 with the vertical stem extends downwards to the second adhesive surface 18, wherein it is disposed in another receiving member for providing greater support and stability to the blade assembly 20. The components of a member of plurality of blade assemblies such as rotary blades and spacers are sandwiched in between the hemispherical protective cap and the receiving member.

In an embodiment of the present invention, the shaving device 1 is configured to cover the entire distal end of the finger including the surfaces of the fingertip, the finger nail plate and the finger nail grooves.

In another embodiment of the present invention, the shaving device 1 is configured to cover a finger either in part or as a whole.

In another embodiment of the present invention, the number of blade assemblies 20 on the first shaving surface 2 is in the range of 4 to 30 for a fingertip surface area admeasuring about 400 sq. mm to 600 sq. mm.

In an embodiment of the present invention, the thickness of the flexible substrate layer characterizing the shaving device 1 is in the range of 0.016 mm to 0.024 mm.

In an embodiment of the present invention, the thickness of the protective peel off layer is in the range of 0.016 mm to 0.025 mm.

In an embodiment of the present invention, the thickness of rotary blades and spacers is in the range of 0.2 mm to 0.25 mm.

In an embodiment of the present invention, the height of the hemispherical protective cap with a vertical stem is in the range of 0.2 mm to 0.25 mm.

In an embodiment of the present invention, the flexible substrate layer characterizing the shaving device 1 may not be provided with breathable openings.

For using the fingertip shaving device, the user will first remove the protective peel off layer and mount the device onto the fingertip. During the shaving, the contact between the user's leading finger and skin facilitates control of the device and the pressure being applied to achieve desired finish and closeness of the shave. The user can move the device in any direction. The shaving device is sized to easily and safely reach difficult to access areas such as within nose or ears and loose or wrinkled skin along the contour of the shaving surface.

While the invention has been described with reference to above embodiments, additional modifications can be made without departing from the spirit and scope of the invention as a whole.

The invention claimed is:

1. A fingertip mountable shaving device characterized by a flexible substrate layer comprising (i) a first shaving surface, further comprising a. a plurality of blade assemblies affixed at predetermined locations;

b. a plurality of rubber strips running along a vertical peripheral edge of the first shaving surface;

wherein a member of said plurality of blade assemblies further comprises a plurality of rotary blades of different diameters with central openings, a plurality of spacers with central openings, a hemi-spherical protective cap with a vertical stem, wherein said rotary blades are alternately positioned above said spacers and said hemi-spherical protective cap with a vertical stem is positioned on top with the vertical stem extending through the central openings of said rotary blades and said spacers;

(ii) a second adhesive surface coated with an adhesive and covered with a releasably connected protective peel off layer;

wherein the second adhesive surface is on an opposing side of the flexible substrate layer from the first shaving surface.

2. A fingertip mountable shaving device according to claim 1 wherein said flexible substrate layer is provided with a plurality of breathable openings.

3. A fingertip mountable shaving device according to claim 1 wherein a member of the plurality of blade assemblies has a single pair of rotary blade and spacer.

4. A fingertip mountable shaving device according to claim 1 wherein a member of the plurality of blade assemblies has two pairs of rotary blades and spacers.

5. A fingertip mountable shaving device according to claim 1 wherein the diameter of rotary blades and spacers has a value in the range of 1 mm to 2 mm.

6. A fingertip mountable shaving device according to claim 1 wherein the thickness of the flexible substrate layer characterizing the shaving device has a value in the range of 0.016 mm to 0.024 mm.

7. A fingertip mountable shaving device according to claim 1 wherein the thickness of the protective peel off layer has a value in the range of 0.016 mm to 0.025 mm.

8. A fingertip mountable shaving device according to claim 1 wherein the thickness of rotary blades and spacers has a value in the in the range of 0.2 mm to 0.25 mm.

9. A fingertip mountable shaving device according to claim 1 wherein the height of the hemispherical protective cap with the vertical stem has a value in the range of 0.2 mm to 0.25 mm.

10. A fingertip mountable shaving device according to claim 1 wherein the provided number of blade assemblies has a value in the range of 4 to 30 in a surface area of 400 sq·mm to 600 sq·mm.

11. A fingertip mountable shaving device according to claim 1 wherein the shape of the rotary blades is circular.

12. A fingertip mountable shaving device according to claim 1 wherein the adhesive coated on second adhesive surface is hypoallergenic and pressure sensitive.

13. A fingertip mountable shaving device according to claim 1 wherein the flexible substrate layer is made of a material selected from a group consisting of latex based, non-latex based, natural and synthetic fibres.

14. A shaving device according to claim 1, wherein the shaving device is configured to cover a surface of an entire finger.

15. A shaving device according to claim 1, wherein the shaving device is configured to cover a part of a surface of an entire finger.

16. A shaving device according to claim 1, wherein the shaving device is configured to cover an entire distal end of a finger.

* * * * *